US007695218B2

(12) United States Patent
Maione

(10) Patent No.: US 7,695,218 B2
(45) Date of Patent: Apr. 13, 2010

(54) METHOD TO INCREASE A CAPABILITY OF SOIL TO SUSTAIN LOADS

(76) Inventor: Nicola Maione, Via Acquabianca I-81057, Teano, Caserta (IT)

( * ) Notice: Subject to any disclaimer, the term of this patent is extended or adjusted under 35 U.S.C. 154(b) by 0 days.

(21) Appl. No.: 11/884,026

(22) PCT Filed: Feb. 6, 2006

(86) PCT No.: PCT/IT2006/000059

§ 371 (c)(1),
(2), (4) Date: Oct. 10, 2007

(87) PCT Pub. No.: WO2006/085349

PCT Pub. Date: Aug. 17, 2006

(65) Prior Publication Data

US 2008/0101876 A1 May 1, 2008

(30) Foreign Application Priority Data

Feb. 9, 2005 (IT) ..... NA2005A0008

(51) Int. Cl.
*E02D 3/12* (2006.01)
*E02D 5/54* (2006.01)

(52) U.S. Cl. ..... 405/269; 405/239; 405/302.4

(58) Field of Classification Search ..... 405/231, 405/232, 233, 239, 244, 263–269, 302.4, 405/258.1

See application file for complete search history.

(56) References Cited

U.S. PATENT DOCUMENTS

| | | | | |
|---|---|---|---|---|
| 3,332,247 | A | 7/1967 | Proctor | |
| 3,969,902 | A * | 7/1976 | Ichise et al. | 405/267 |
| 4,971,480 | A * | 11/1990 | Nakanishi | 405/269 |
| 5,039,256 | A | 8/1991 | Gagliano et al. | |
| 5,217,327 | A * | 6/1993 | Nakanishi | 405/269 |
| 5,256,004 | A * | 10/1993 | Gemmi et al. | 405/237 |
| 5,382,116 | A * | 1/1995 | Nakanishi | 405/269 |
| 5,399,056 | A * | 3/1995 | Shibazaki et al. | 405/233 |
| 5,435,668 | A * | 7/1995 | Shibazaki et al. | 405/233 |
| 5,494,378 | A * | 2/1996 | Hanson | 405/244 |
| 5,975,808 | A * | 11/1999 | Fujita | 405/244 |
| 6,120,214 | A * | 9/2000 | Iovino | 405/241 |
| 6,435,777 | B1 * | 8/2002 | Yoshii et al. | 405/244 |

FOREIGN PATENT DOCUMENTS

| | | |
|---|---|---|
| JP | 55-155820 A | 12/1980 |
| JP | 61-109822 A | 5/1986 |

* cited by examiner

*Primary Examiner*—Frederick L Lagman
(74) *Attorney, Agent, or Firm*—Young & Thompson

(57) ABSTRACT

A method for increasing the load-sustaining capability of structural elements in soil, wherein metallic rostrums are positioned in a hole in the soil and subsequently extruded telescopically to force them to penetrate into the surrounding soil at a desired depth and inclination. Mortars or consolidation mixes may be injected through the rostrums to fill a volume in the soil to form reinforcement bulbs.

20 Claims, 6 Drawing Sheets

A
A

METHOD TO INCREASE A CAPABILITY OF SOIL TO SUSTAIN LOADS

BACKGROUND OF THE INVENTION

In particular soils (incoherent sands or silts, peat layers, plastic clays etc.), it is difficult to transfer compression and/or tension loads; it becomes therefore necessary to intervene with technical solutions, for instance using alternative expensive systems of foundation (jet grouting, tubfix micropiles, etc.).

These systems have the tendency to create in one or more points of the pile, of the tie rod and of the foundation wall or of the masonry chain, some bulbs that improve the possibility to transfer loads from the superstructure to the soil or to another structure or alternatively to oppose to the loads themselves.

Another way consists of assigning to the structure of foundation minimum bearing capacity because of the soil's very low strength parameters.

In some cases it is necessary to perform repeated injections of cement mixing to improve the soil characteristics, with very expensive costs.

In the case of tie rods—with harmonic steel reinforcement section, or steel bars with elevated tensile limit to anchor to the ground, for instance, walls of support, radio antennas, etc.—it can happen that the performance is not successful due to the poor mechanical characteristics of the soil, incapable to resist to tensile forces. Consequently necessary reconstruction works are requested or, alternatively, new tie rods with lower tensile capabilities.

The same can be said for foundation piles, where low strength parameters compel the design engineer to reduce the unit load by increasing the total number of pile for the overall foundation.

Another problem is related to the execution of the works of improvement of the soil, that requires full skill and ability of the operator strictly coming from his experience, the perfect functionality of the operative equipments and homogeneity of the soil complex; all these things are not always verifiable.

SUMMARY OF THE INVENTION

Purpose of the present patent for industrial invention is to propose a method that allows to increase in notable way the bearing capacity of the soil for supporting loads.

The idea consists of using a mechanism that allows to place within the foundation pile body or within the tie rod, special rostrums that are inserted into the soil from the steel cast; in such way some reinforced armed bulbs are created.

The system of fixing of the rostrums to the steel reinforcement cast can be of various types: welding, mechanical joint, binding with flexible threads etc. Every rostrum is realized in such a way that allows to inject through it any fluid.

The rostrums can have any inclination with the longitudinal axis of the pile, can be in any number both in a radial disposition on the section of the pile, and along its axis.

This solution is better expressed by the enclosed figures where a practical application even though not restrictive is represented.

DETAILED DESCRIPTION OF THE PREFERRED EMBODIMENTS

Figure 1:
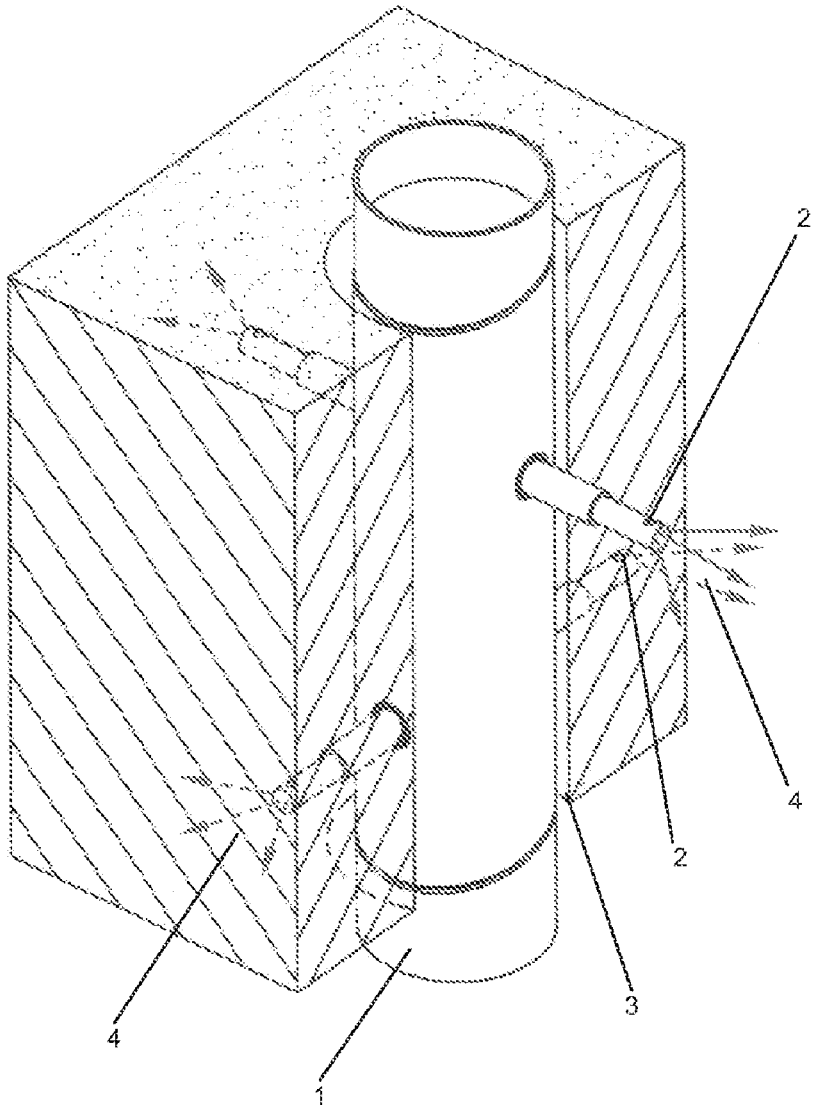
FIG. 1 illustrates in a sectioned axonometric view a socket (1) inserted in a borehole containing the telescopic rostrums (2) and bulbs (4) in the ground and around the same rostrums.
Figure 2:
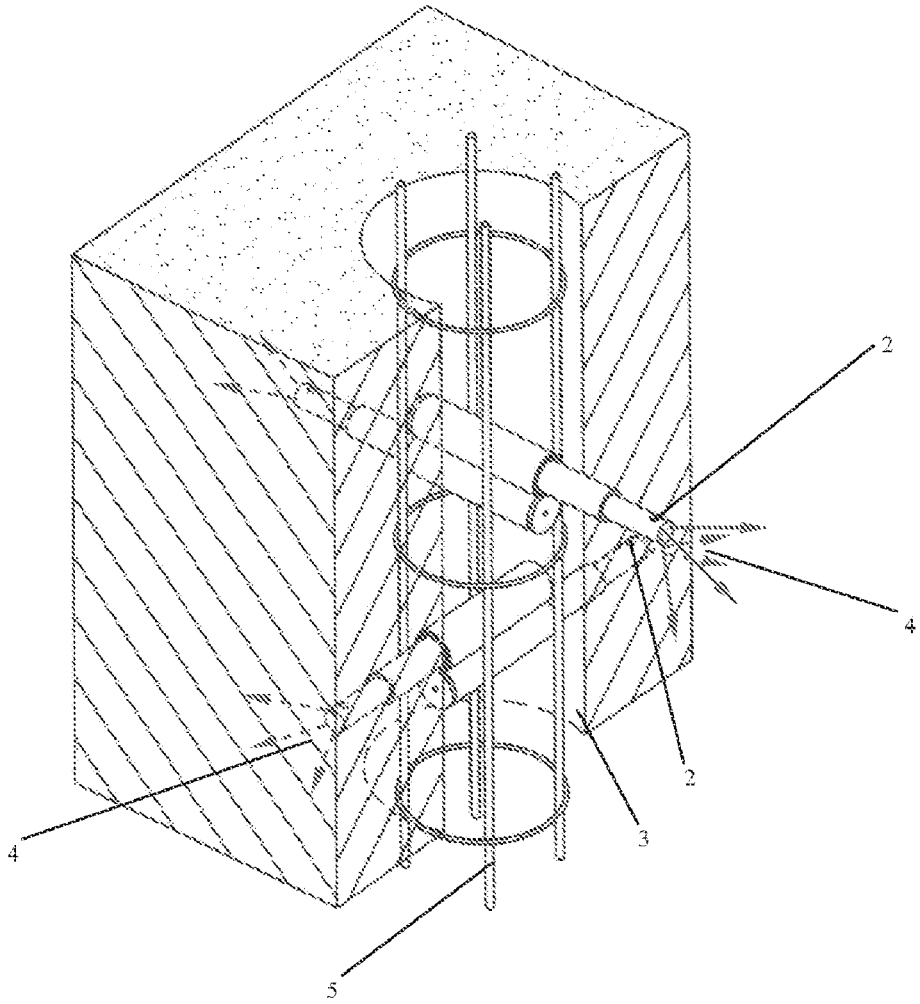
FIG. 2 shows the application of the rostrums to a steel mesh of a pile (5).

As shown in FIG. 1 in a sectioned axonometric view, a socket (1) inserted in a borehole containing the telescopic rostrums (2) . Once the socket is installed in the borehole, the pistons are allowed to extend at the design depth by injecting mixes. Bulbs (4) in the ground and around the same rostrums are formed that allow to increase the bearing capacity of the soil.

Figure 4:
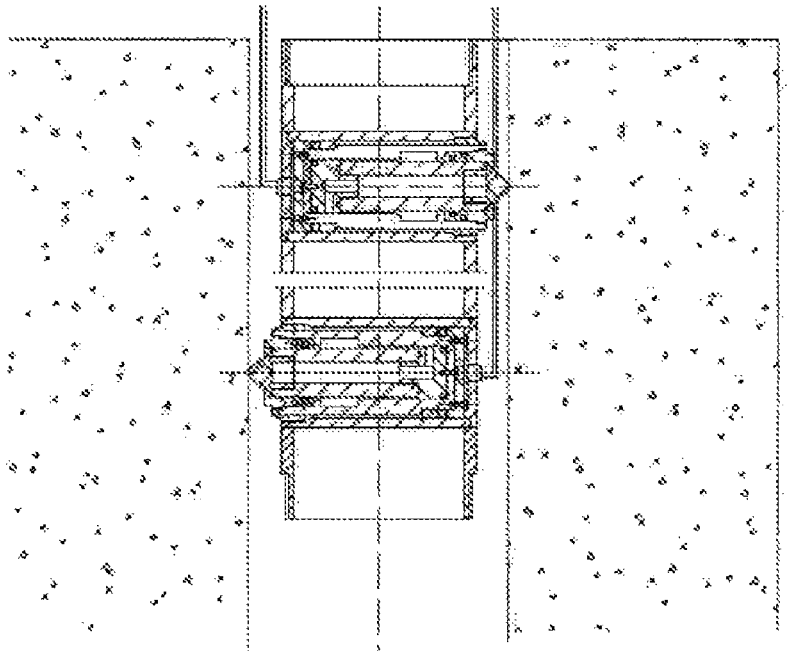
FIGS. 3, 4, 5, and 6 show rostrums constituted by a telescopic system.
Figure 3:
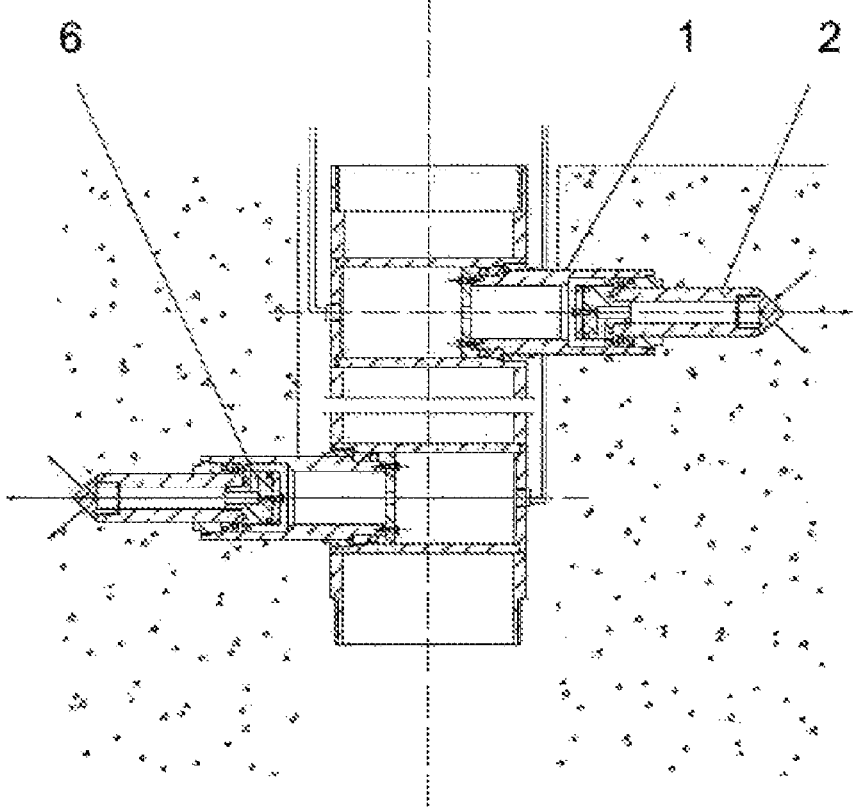
Figure 6:
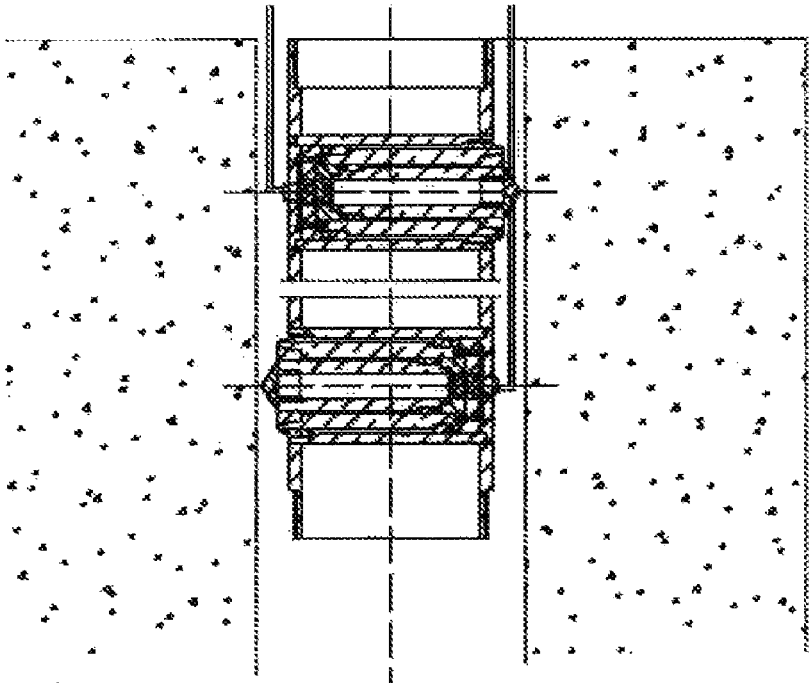
Figure 5:
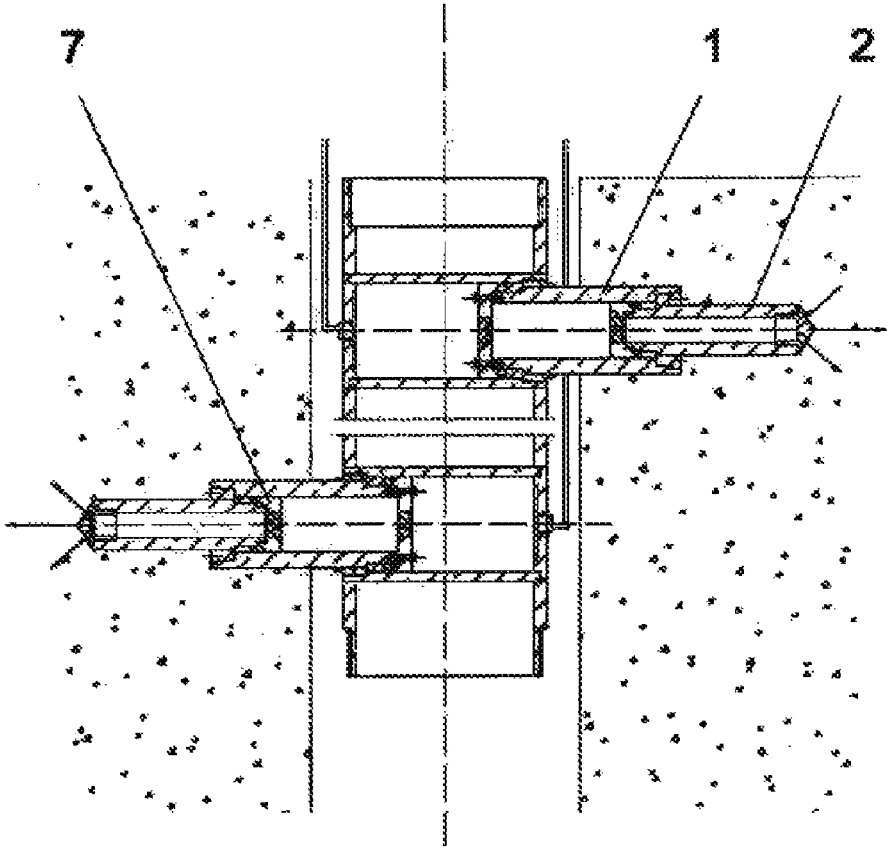

In FIGS. 4 and 6, the rostrums with a telescopic system enter the borehole in a short configuration, then extend up to their maximum extended length by means of various components sliding on each other as shown in FIGS. 3 and 5. In this way, the telescopic rostrums (2) penetrate into the surrounding ground.

Figures 7, 7A, 7B:
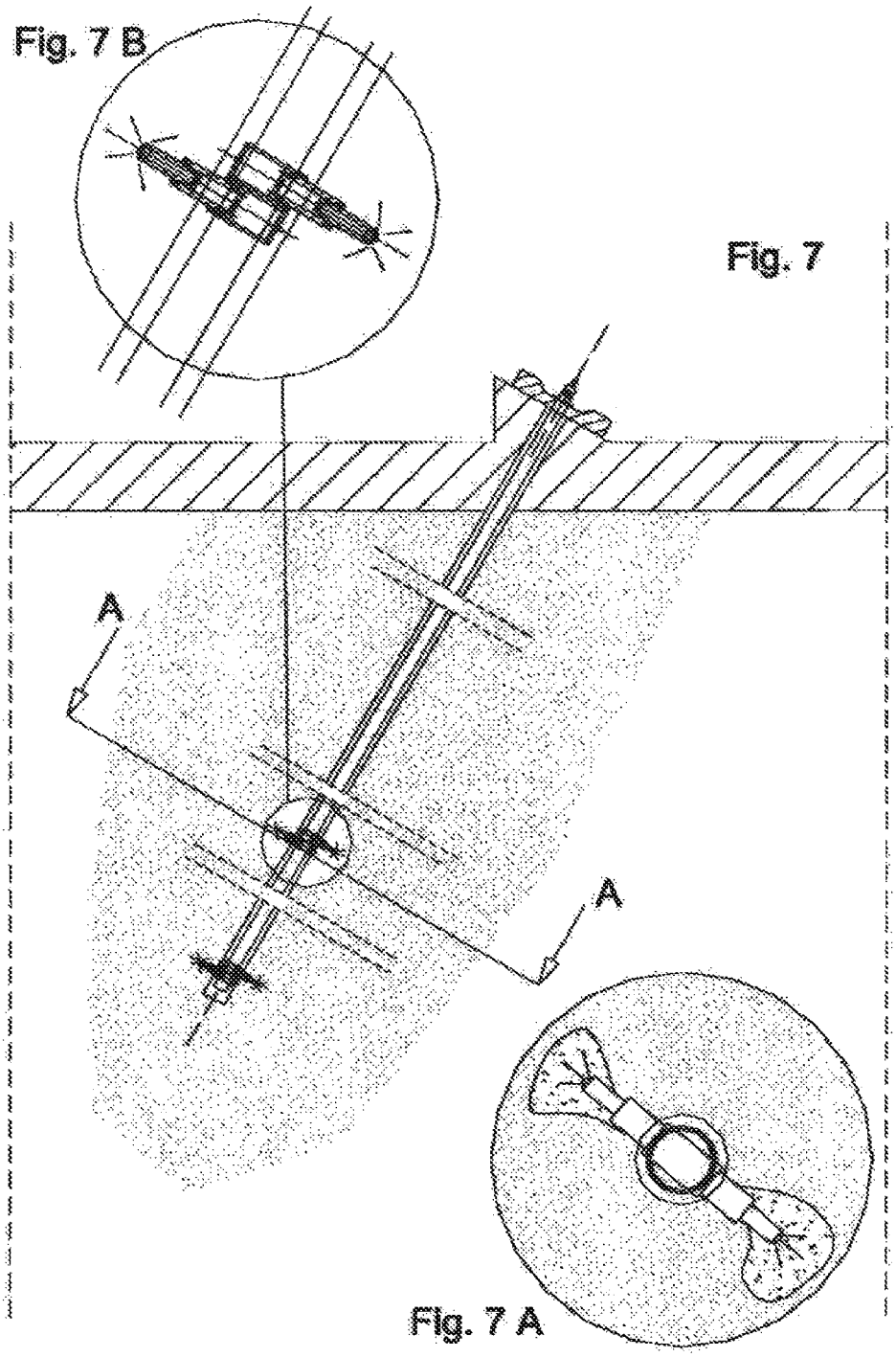
FIG. 7 illustrates armed bulbs realized on connecting rods.

FIG. 7 illustrates armed bulbs realized on connecting rods. The number of armed bulbs on every connecting rod in operation case may vary based on the demands of the project.

Figure 8:
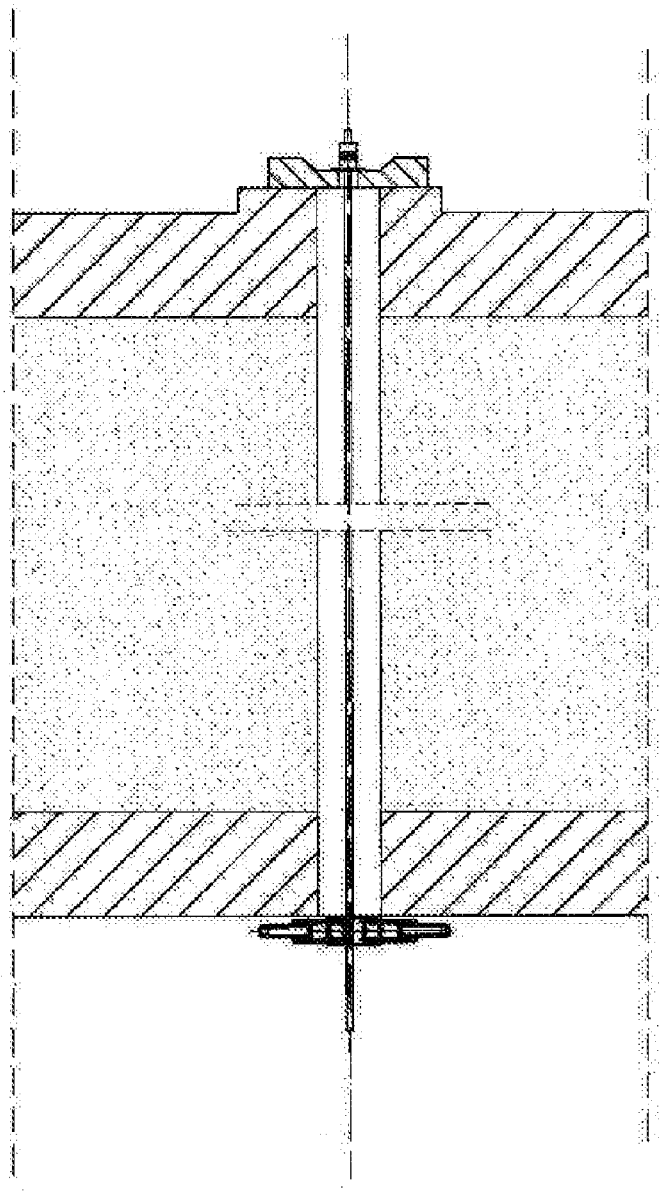
FIG. 8 illustrates an armed bulb applied to the terminal of a chain.

In another embodiment, FIG. 8 shows an armed bulb applied to the terminal end of a chain.

Rostrum extrusion is best realized by injecting fluids under pressure in it (incompressible liquid or compressible gas).

The injected fluid passes from an element of the telescopic system to the following, through a path (inside the rostrum) such that when total elongation is obtained it is possible to inject any other fluid (waterproof, consolidating, etc.) in the ground. Therefore such path has to end inside the last unthreaded element, after allowing—during the elongation, to reach the necessary pressure at the base of every element to get the push that permits the unthreading.

Various possibilities exist to realize this condition. In FIGS. 3 and 4, for instance, the existence of a bypass has been hypothesized, (6) in the pipe, realized through a groove, that constitutes the last but one unthreaded element. The by-pass allows the fluid to pass inside the last unthreaded element and from this to the surrounding ground.

Another possibility is pointed out as illustrated in FIGS. 5 and 6 showing valves (7) (or disks of breakage) set at the base of every element to be extruded; they manage, with their opening, the sequence of unthreading and therefore the injection of the fluid in the last extruded element and from this into the surrounding ground.

The unthreading may also be realized through specific kinematisms composed of rigid or flexible components. The width of every rostrum must be defined for each case. It is a function of various parameters: diameter of the borehole, cost/benefit ratio, soil strength, maximum diameter of the telescopic system, load borne by every rostrum, material used for the realization of the rostrum, maximum pressure of the used fluids.

By this presentation it results clear that the method consists of positioning in interested points of the foundation or of the connecting rod of anchorage, a socket containing dynamic pistons in the inside that, once installed in the ground at the design depths, are allowed to extrude so that they are thrusted into the ground creating some physical bulbs that notably increase the bearing capacity of the grounds to suffer both tensile (anchorages) and compressive loads (foundations).

A further positive effect can be obtained by injecting through the pistons mortars or consolidating mixtures. The rostrums realize in one or more points of the pile, of the connecting rod, of the foundation, or of the building chain, bulbs that enormously improve the possibility to oppose loads or to transfer them from the building to the ground, or to a structure.

The rostrums (or nails), allow to realize, further to an exponential increase of the surface of contact foundation-soil, even actual "armed bulbs."

The bulbs if exclusively constituted by the injected mixtures have the characteristics of mechanical resistance of such mixtures.

The hollow bulbs are composed of the mass of the injected consolidating mixture, in the body of which the rostrums, i.e. a metallic armour structurally connected to the armour of the pile (or connecting rod) and with a mechanical strength of the same order of magnitude of that of such primary armour. In the case of connecting rods then the ability to oppose the applied strengths amazingly increases since amazingly increases the surface of contrast.

The rostrums in the illustrated examples have been supposed to be single headed but they can also have multiple heads.

Formal and structural variations can be made to the described method within the bounds of the same inventive concept that is defined by the following claims.

The invention claimed is:

1. A method to increase the ability of soils to bear loads, comprising the steps of:

positioning, in one or more points of armour of piles, connecting rods, or chains, a device configured to thrust rostrums in the ground, wherein the rostrums are configured such that any of mortars and consolidating or waterproof mixtures are injectable therethrough.

2. The method according to claim 1, wherein the rostrums are configured for the injection of mortars and mixtures of any type therethrough.

3. The method according to claim 1, wherein the rostrums are anchored in the one or more points of the armour, and wherein the rostrums are dropped with the armour in excavations.

4. The method according to claim 1, wherein the device is further comprised of systems configured to provoke an extrusion of the rostrums and to thrust the rostrums into any of soil, rocks, and structures.

5. The method according to claim 1, wherein the rostrums are further configured to lengthen telescopically to reach a desired elongation.

6. The method according to claim 1, wherein the rostrums are thrust by hydraulic, pneumatic or mechanical means to elongate into a desired elongation.

7. The method according to claim 1, wherein the rostrums are single headed.

8. The method according to claim 1, wherein the heads of the rostrums are multiple.

9. A method to increase the ability of soil to bear loads, comprising the step of:

positioning a device in one or more points of armour at a depth within the ground, wherein the device is comprised of rostrums configured to be extendable in a direction away from the device, wherein the depth is such that the rostrums are completely submerged within the ground, and wherein the device is configured to thrust the extendable rostrums into the ground surrounding the device.

10. The method according to claim 9, wherein the rostrums are configured to receive fluids injected therethrough.

11. The method according to claim 9, wherein the rostrums are further comprised of pistons configured to extend telescopically in the direction away from the device.

12. The method according to claim 10, further comprising the steps of:

extending the rostrums further into the ground; and upon the rostrums reaching a maximum extension, injecting the fluids through the rostrums and into the ground at a terminal end of each rostrum.

13. The method according to claim 10, wherein the fluids comprise one of a mortar and a consolidating mixture.

14. The method according to claim 9, wherein the rostrums self-extend in the direction away from the device.

15. The method according to claim 10, wherein the rostrums are further comprised of bypasses, wherein the rostrums are configured to extend under the influence of a first fluid, injected into the rostrums under pressure, until the rostrums are fully extended, and wherein the bypass is configured, upon the rostrums becoming fully extended, to allow a second fluid to pass through a terminal end of the rostrums into the ground.

16. The method according to claim 10, wherein the rostrums are further comprised of extendable elements and a valve associated with each element, and wherein the rostrums extend by means of a thrusting of each of the extendable elements under the influence of a first fluid, the extension of each element controlled by an opening of the valve of the element, and wherein a valve of a final element thrusted, upon reaching a maximum extension, is configured to inject a fluid into the ground.

17. The method according to claim 9, wherein the armour comprises any of a foundation and an anchorage.

18. The method according to claim 9, wherein the device is a steel cast.

19. A method to increase the ability of soil to bear loads, comprising the steps of:

providing an armour of piles, connecting rods, or chains;

providing a device comprised of rostrums in one or more points of the armour;

positioning the armour and the device in the ground such that the rostrums are completely submerged within the ground; and causing the rostrums of the device to extend outward from the device and thrust further into the ground in directions inclined with a longitudinal axis of the device.

20. The method according to claim 19, further comprising the step of:

upon the rostrums reaching a maximum extension, injecting fluids through the rostrums and into the ground at a terminal end of each rostrum.

* * * * *